US010661115B2

(12) United States Patent
Wagner

(10) Patent No.: US 10,661,115 B2
(45) **Date of Patent: *May 26, 2020**

(54) STATIONARY MANUAL EXERCISE SLED

(71) Applicant: Christopher Wagner, Los Angeles, CA (US)

(72) Inventor: Christopher Wagner, Los Angeles, CA (US)

( * ) Notice: Subject to any disclaimer, the term of this patent is extended or adjusted under 35 U.S.C. 154(b) by 84 days.

This patent is subject to a terminal disclaimer.

(21) Appl. No.: 15/832,147

(22) Filed: Dec. 5, 2017

(65) Prior Publication Data

US 2018/0093130 A1 Apr. 5, 2018

Related U.S. Application Data

(63) Continuation of application No. 15/067,064, filed on Mar. 10, 2016, now Pat. No. 9,833,657.
(Continued)

(51) Int. Cl.
*A63B 22/02* (2006.01)
*A63B 21/00* (2006.01)
(Continued)

(52) U.S. Cl.
CPC ..... *A63B 22/02* (2013.01); *A63B 21/00069* (2013.01); *A63B 21/00192* (2013.01); *A63B 21/227* (2013.01); *A63B 22/0023* (2013.01); *A63B 22/0285* (2013.01); *A63B 22/18* (2013.01); *A63B 23/0405* (2013.01); *A63B 2022/0278* (2013.01); *A63B 2210/50* (2013.01); *A63B 2225/09* (2013.01)

(58) Field of Classification Search
CPC . A63B 22/02; A63B 22/0285; A63B 22/0023; A63B 22/18; A63B 21/227; A63B 21/00192; A63B 21/00069; A63B 23/0405; A63B 2210/50; A63B 2225/09; A63B 2022/0278
See application file for complete search history.

(56) References Cited

U.S. PATENT DOCUMENTS 7,357,758 B2 * 4/2008 Polk, III ..... A63B 22/0023 482/54
7,381,161 B2 * 6/2008 Ellis ..... A63B 21/154 482/51
(Continued)

*Primary Examiner* — Megan Anderson
(74) *Attorney, Agent, or Firm* — Michael L. Greenberg, Esq.; Greenberg & Lieberman, LLC

(57) ABSTRACT

A manual non-motorized exercise treadmill with the ability to provide adjustable resistance to perform strength training resistance movements and simulate the movements of an exercise drive sled in a stationary location is described. A treadmill deck of the treadmill is supported by friction-reduction rollers, a front treadmill roller and a rear treadmill roller. The treadmill is operated by the user pushing and/or pulling with the feet of the user via a belt or harness attached to adjustable stationary hand bars. Variable resistance allows for increased or decreased difficulty in achieving the exercise according to the preference and ability of the user. The resistance is configured to be applied to the rollers and/or belt, making it more difficult for the user to manually move the treadmill belt. The treadmill belt is configured to oscillate for both concentric and eccentric exercises not provided by conventional treadmills.

17 Claims, 5 Drawing Sheets

Related U.S. Application Data

(60) Provisional application No. 62/250,882, filed on Nov. 4, 2015, provisional application No. 62/131,147, filed on Mar. 10, 2015.

(51) Int. Cl.

| | |
|---|---|
| ***A63B 22/00*** | (2006.01) |
| ***A63B 22/18*** | (2006.01) |
| ***A63B 23/04*** | (2006.01) |
| ***A63B 21/22*** | (2006.01) |

(56) References Cited

U.S. PATENT DOCUMENTS

| | | | | |
|---|---|---|---|---|
| 7,641,597 | B2 * | 1/2010 | Schmidt | A63B 21/0058 482/4 |
| 9,521,901 | B2 * | 12/2016 | Dalebout | A63B 22/02 |
| 2007/0123396 | A1 * | 5/2007 | Ellis | A63B 21/0618 482/54 |
| 2014/0274578 | A1 * | 9/2014 | Kennedy | A63B 21/015 482/54 |

* cited by examiner

STATIONARY MANUAL EXERCISE SLED

CONTINUITY

This application is a continuation of non-provisional patent application Ser. No. 15/067,064, filed on Mar. 10, 2016, which claims priority to provisional patent application No. 62/250,882, filed on Nov. 4, 2015, and to provisional patent application No. 62/131,147, filed on Mar. 10, 2015, and priority is claimed thereto.

FIELD OF THE PRESENT INVENTION

The present invention relates to instruments for physical training and exercise. More specifically, the present invention relates to a manual treadmill that allows the user to perform nearly any strength training exercises including the simulation of an exercise sled in a stationary location.

BACKGROUND OF THE PRESENT INVENTION

A variety of treadmill devices are widely used as a means of physical activity or therapy in confined areas, typically indoors. These treadmills generally are used to simulate walking or running to improve cardiovascular health and fitness. Treadmills allow users to walk or run in a stationary location by the use of a closed looped belt, conventionally rotated around two or more rollers. The belt can be driven manually by the user, or by a motor. A variety of exercise sleds are now also being widely used by athletes and the general population as a means of improving athletic performance, strength, and endurance. These exercise sleds allow users to push, pull, or drag the apparatus. These devices allow users to increase the amount of resistance at will. To do so, one must manually add weight plates or other objects to the apparatus. However, these exercise devices require great deal of indoor or outdoor space to be effectively used. Without adequate space, the workout quickly becomes tedious, and endurance cannot be exercised due to constant adjustment and turning of the apparatus within a confined space.

Additionally, conventional manual treadmills are equipped with a front treadmill roller and a rear treadmill roller, and often employ a surface with minimal friction between the rollers, to facilitate the movement of the treadmill belt when weight is applied. This can cause the treadmill belt to become difficult to reverse direction and hinder the ability to perform many resistance exercises. This is due to the amount of friction between the treadmill deck and the treadmill belt underneath the user's foot. If there were a multitude of small treadmill rollers positioned between the large front and rear treadmill rollers, internal friction could be minimized, and the resistance and weight could be more evenly distributed among the rollers, making it easier for the user to rapidly reverse the direction of the treadmill during exercise, as well as perform many resistance exercises.

Thus, there is a need for a device that can provide the exercise maneuvers of a mobile exercise sled, while remaining stationary for comfortable use indoors. Such a device is preferably equipped with a treadmill, capable of providing variable resistance levels while remaining mechanically driven. Additionally, such a device is ideally adjustable in size, and may be used with a variety of ropes and harnesses to achieve a wide assortment of exercises that workout every muscle group in the body.

Technogym™ offers a product known as a 'Skill Mill,' which provides a variety of exercises to the user, including resistance training exercises. However, the Skill Mill is not highly adjustable, and is not equipped with adjustable up/down and forward/reverse hand frames. Likewise, the Skill Mill cannot be used by a very large individual. This is in contrast to the present invention, which is equipped with an adjustable hand frame, as well as a modular cross bar. The Skill Mill deck is curved, and therefore limits the usable surface area of the exerciser, and reducing the number of resistance exercises that may be performed. The Skill Mill is also a slat belt treadmill, which increases production costs.

Additionally, Matrix Fitness™ has developed a treadmill capable of use for a variety of exercises. Unlike the present invention, the treadmill of Matrix Fitness™ is a traditional treadmill deck surface, and is built at a fixed incline. This surface increases friction and limits the amount of resistance exercises that can be performed. Likewise, the treadmill available by Matrix Fitness™ cannot easily be used by larger individuals. The present invention is the first treadmill to allow a user to perform every type of resistance exercise.

SUMMARY OF THE PRESENT INVENTION

The present invention allows a user to accomplish the exercises of a sled while remaining in a stationary location. The invention accomplishes this by creating a frame of an adjustable hand bar to a manual treadmill with adjustable resistance. The invention also adds user benefits to both the capabilities of a treadmill and exercise sled.

The present invention is equipped with an adjustable hand bar that adds two primary benefits to a traditional exercise sled: First, the hand bar allows the user to exercise from different angles allowing them to engage different muscles than a traditional sled. Namely, the hand bar can be positioned at any angle defined by the user. Second, it increases safety for users. A traditional sled can place a taller individual or an individual with certain physical limitations in a compromising position and not allow the user to safely and effectively perform the desired exercise.

The hand frame is constructed of two parallel posts. Both of these posts have parallel adjustments, running along the length of the posts, for a hand bar to be attached perpendicular to. The posts themselves can also be used for the user to place their hands on to push. The hand bar running perpendicularly to both vertical posts, and secured within at least one hand bar mount, allow the user to place their hands to push against. The hand bar also allows the user to attach a belt, rope, or harness from the hand bar to the user's body. This attaches the user to the frame allowing them to pull, drag, or run.

The present invention also adds many benefits to the traditional treadmill. A traditional treadmill successfully allows the user to almost perfectly simulate outdoor running or walking in a stationary location indoors. Unlike with treadmills designed for walking or running, the present invention has the ability to be used with an oscillating motion, with the user sliding up the treadmill via the treadmill belt suspended over a multitude of treadmill friction-reduction rollers, stopping, sliding back down the treadmill, and repeating the process.

Running treadmills are great for cardiovascular health/fitness, but do not allow the user to get the benefits of full body resistance workouts. By adding resistance to a belt of a manual treadmill, the user must activate and engage muscles to keep the belt moving. Resistance can be added to the treadmill in several ways. Any type of resistance (direct, magnetic, frictional, air, or any other type of resistance) can be placed by one skilled in the art to the rollers, flywheel or belt itself, or however one skilled in the art sees fit. This creates the resistance needed to simulate the load of a weighted sled or traditional weights such as dumbbells. The resistance is adjustable to fit physical needs of the user. This allows high performance athletes as well as general population to use the invention. It also allows the user to vary the exercises. It is envisioned that the user can employ a heavy resistance setting to exercise his or her muscle strength and power, or opt for a light resistance workout to exercise his or her speed or to achieve a cardiovascular workout. Similarly, the present invention also allows the user to get a full body workout. The present invention allows the user the ability to work all muscle groups by varying exercises and techniques, all while employing a single workout device.

The treadmill deck platform of the present invention is preferably modified to meet the needs of users of varying sizes. The modification of a conventional treadmill deck to suit the needs of the present invention may be accomplished in two ways. The deck/belt itself can be elongated. This allows users to have a long enough belt to accomplish exercises where a greater range of motion is needed. The second way to modify a treadmill into a functioning exercise sled is to make the frame adjustable. The present invention comprises two separate frames (namely a hand bar and a running deck) that are conventionally fixed together in adjustable manner. This allows users of different sizes to determine the best distance between the hand bars and the end of the running deck to successfully and safely complete the chosen exercise.

The present invention is made to be stored easily. The hand frame of the present invention can be easily removed, which allows individuals to be able to store the treadmill deck underneath furniture. The present invention is also foldable, making it ideal for home use and for easy storage. The running deck of the treadmill is configured to fold and rest vertically between the vertical support posts.

The present invention also has added safety features than a traditional treadmill. The present invention has the capacity to stop the belt immediately once the user disengages the belt without the need for an emergency stopping mechanism. Traditional treadmills typically take several seconds for the moving belt to come to a complete stop. The combination of weighted rollers, subtraction of a flywheel and a brake make the belt be able to come to an instant stop.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 3:
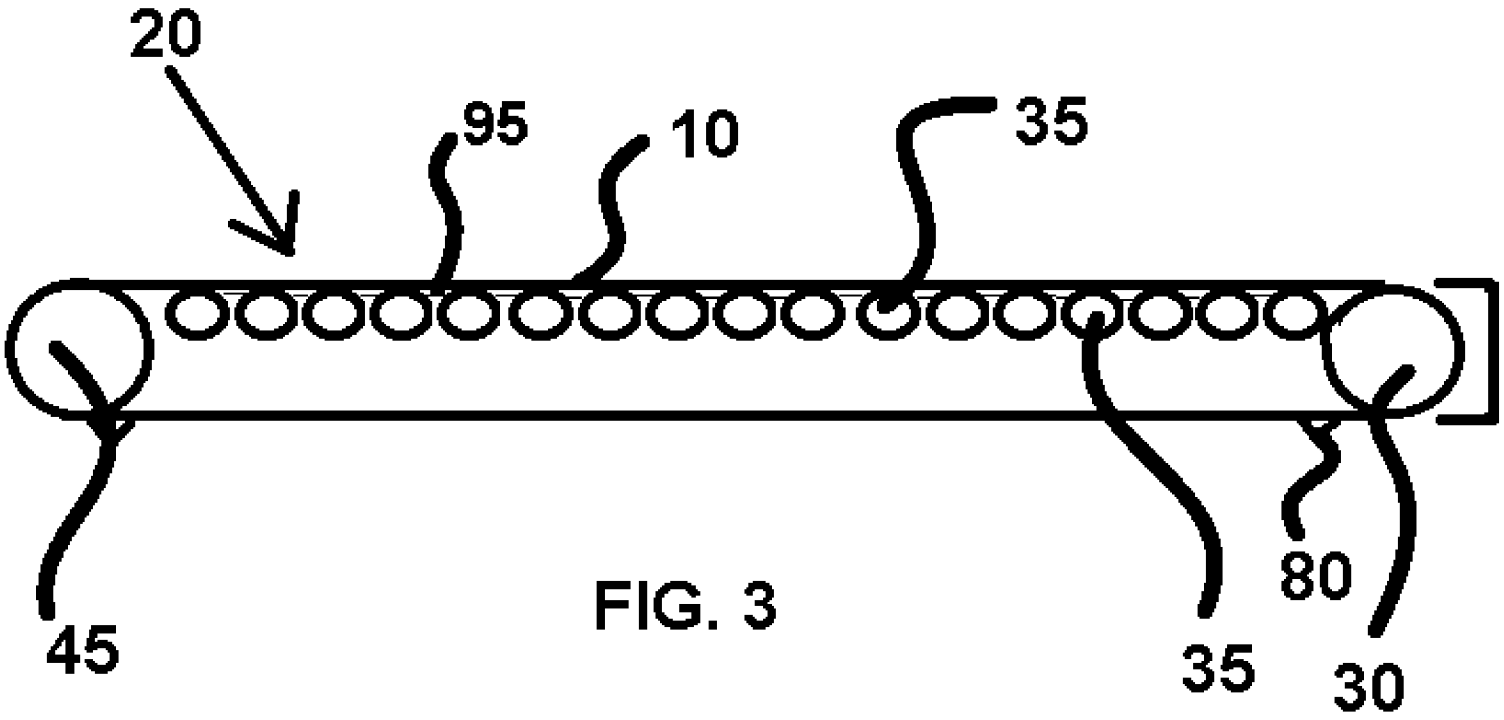
FIG. 3 displays a close-up view of the treadmill rollers and treadmill belt of the present invention as seen from the side.

The present invention is a strength training and manual sled exercise treadmill configured to provide a user with a means of achieving a variety of resistance exercises including sled-based exercises while remaining within a fixed location. As such, the present invention is applicable for performing a wider variety of exercises than traditional treadmills, including sled-based exercises, in addition to simulating running and walking movements. The preferred embodiment of the present invention includes a treadmill belt (10), a treadmill assembly (20), treadmill rollers—including a front treadmill roller (30) and a rear treadmill roller (45), friction-reduction rollers (35), a hand bar (40), a conventional harness, and at least one anchor mount (50). The treadmill assembly (20) preferably comprises a treadmill deck (60), which provides the flat platform on which the user walks along the treadmill belt (10). The treadmill belt (10) of the present invention is configured to tightly wrap around the front treadmill roller (30) and rear treadmill roller (45), with the friction-reduction rollers (35) disposed between the front treadmill roller (30) and rear treadmill roller (45), as seen in FIG. 3.

The friction-reduction rollers (35) function in tandem with the treadmill rollers, and help to avoid the conventional friction caused when employing solely conventional treadmill rollers. The removal of a portion of the friction of the system of the present invention via the friction-reduction rollers (35) helps to facilitate the quick change of direction of the front treadmill roller (30) and rear treadmill roller (45) during use, as well as the ability to perform resistance exercises. The treadmill deck (60) is preferably supported by feet (80), which are preferably adjustable vertically, to ensure the treadmill deck (60) of the present invention may be easily leveled on slightly uneven surfaces for use, as well as to easily increase or decrease the incline of the treadmill deck (10).

Figure 1:
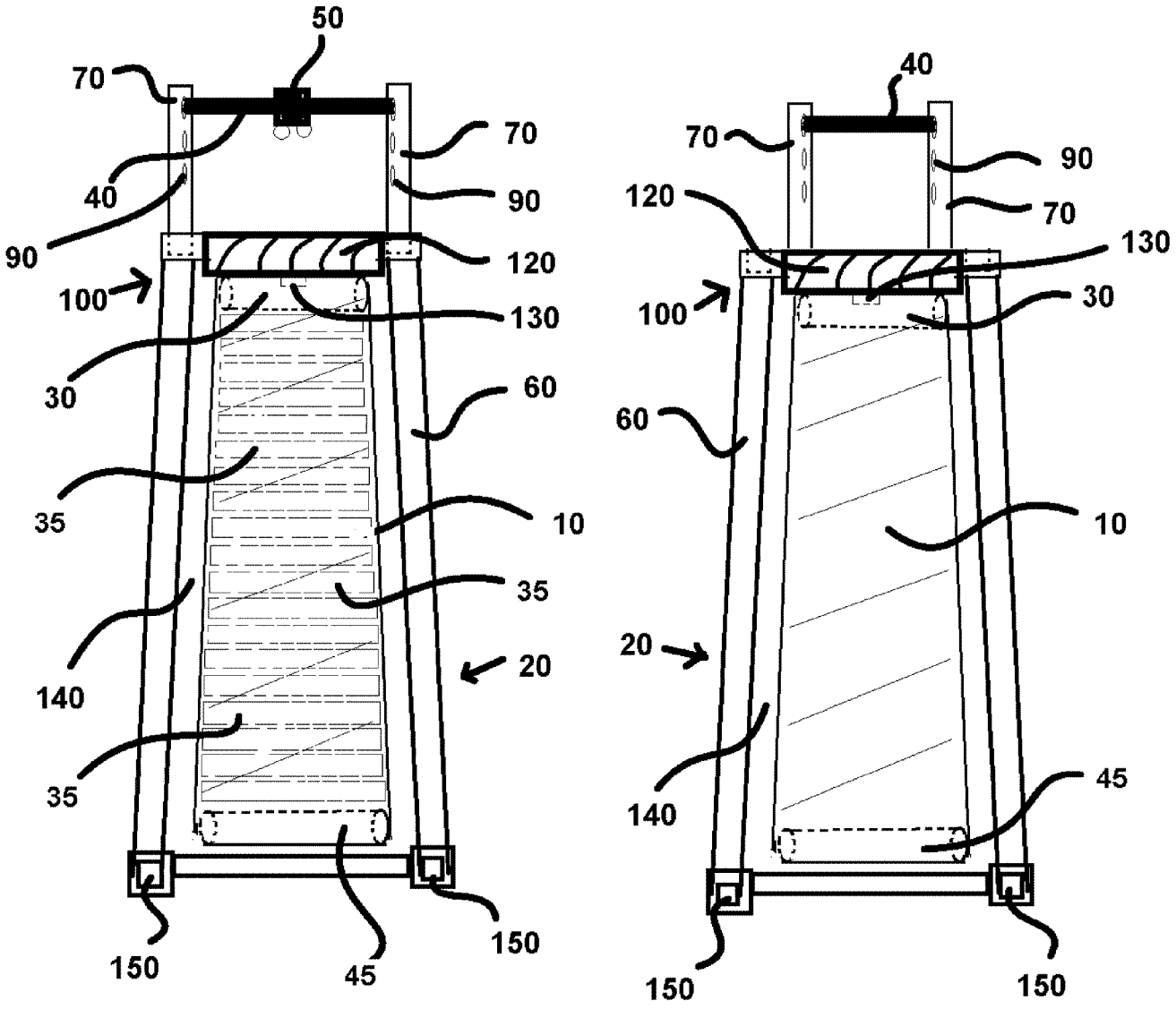
FIG. 1 exhibits two views of the preferred embodiment of the present invention as seen from the rear, denoting the adjustable vertical posts.
Figure 2:
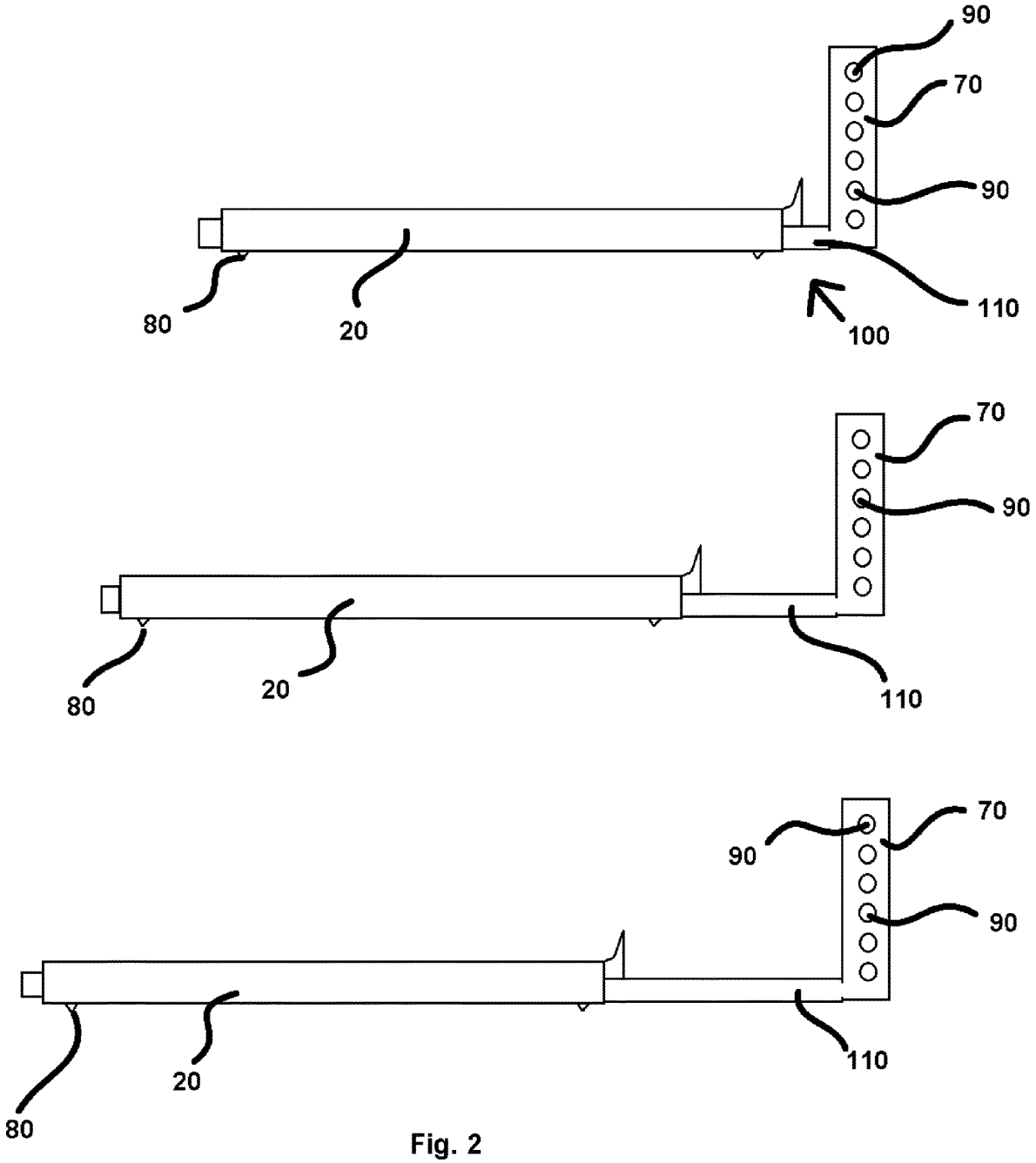
FIG. 2 shows the extendable frame of the present invention, as seen from the side.
Figure 5:
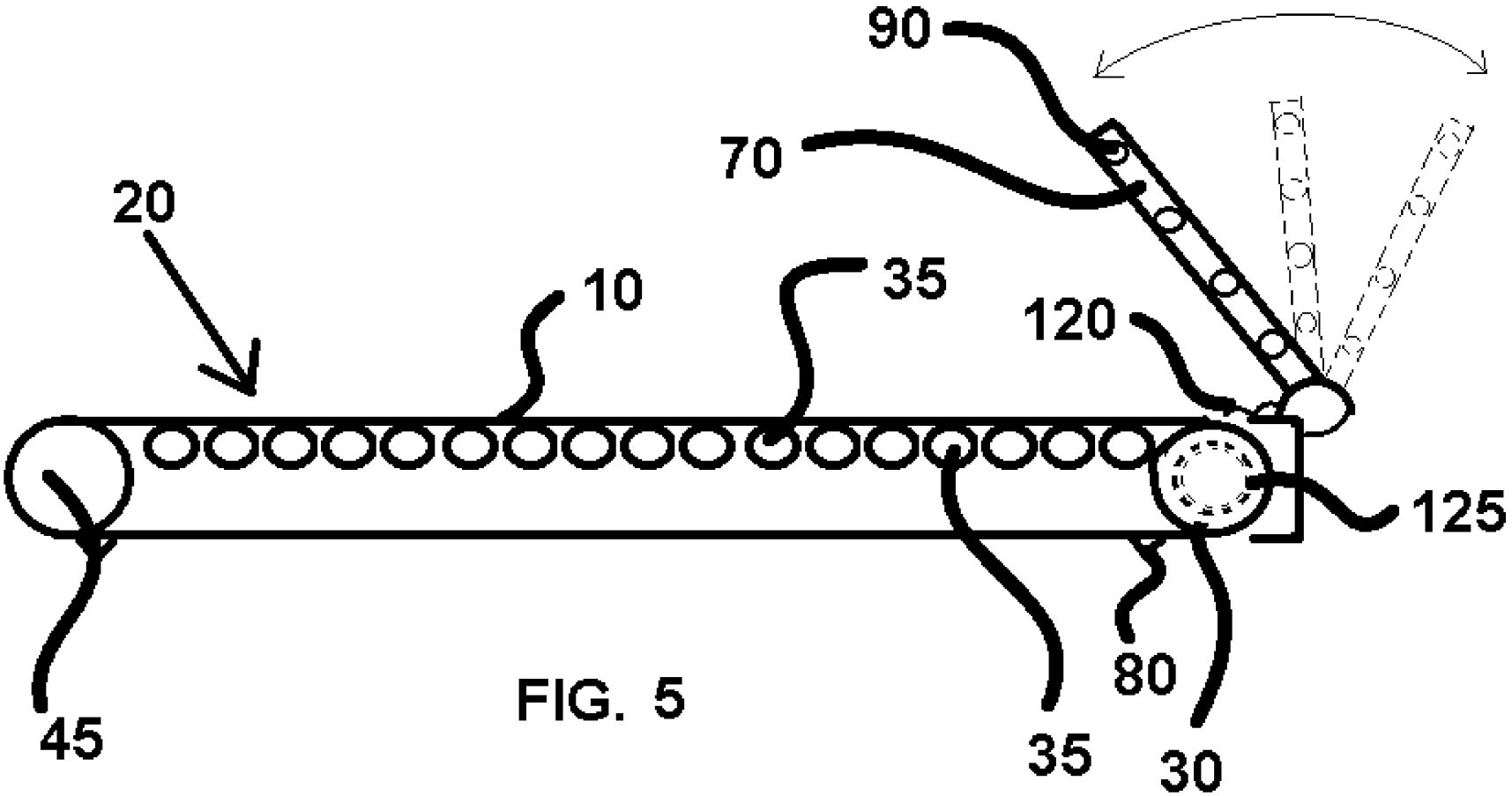
FIG. 5 displays an alternate embodiment of the present invention from the side, detailing the variable angle vertical post.

Additionally, at least one vertical post (70) is disposed at a first end (100) of the treadmill deck (60), as shown in FIG. 1. The hand bar (40) and the at least one anchor mount (50) are preferably disposed on the at least one vertical post (70) of the present invention. The at least one vertical post (70) is preferably equipped with at least one hand bar mount (90), each instance of the at least one hand bar mount (90) is preferably disposed equidistantly from proximal iterations of the at least one hand bar mount (90). The at least one hand bar mount (90) is configured to hold the hand bar (40) level horizontally, so as to provide a sound mounting point for the user during use of the present invention for exercise. Alternate embodiments of the present invention may be equipped with at least one vertical post (70) that is configured to pivot the angle at which it contacts the first end (100) of the treadmill deck (60). Such an alternate embodiment with a variable angle vertical post enables the user to alter both the distance of the at least one vertical post (70) from the user, as well as the height of the at least one vertical post (70), as shown in FIG. 5.

The preferred embodiment of the present invention preferably employs two instances of the at least one vertical post (70), which are oriented at opposing ends of the first end (100) of the treadmill deck (60). The at least one vertical post (70) are configured to move horizontally, such that the distance between the two instances of the at least one vertical post (90) may be adjusted to the preference of the user. Additionally, it is envisioned that the hand bar (40), at least one hand bar mount (90), and at least one vertical post (70) may be easily removed for storage. Additionally, the present invention may be configured to position the at least one vertical post (70), hand bar (40) and at least one hand bar mount (90) on an alternate mounting point (150) located at a second end of the treadmill deck (60).

Similarly, the distance between the treadmill belt (10) and the hand bar (40) of the present invention may also be adjusted in the preferred embodiment of the present invention. An extension portion (110) is disposed between the at least one vertical post (70) and the treadmill deck (60). The extension portion (110) permits the at least one vertical post (70) to extend, sliding the extension portion (110) out from under and within the treadmill deck (60) of the present invention, as seen in FIG. 3, adjusting the overall size of the frame of the treadmill assembly (20) of the present invention. It is envisioned that users should elongate the frame of the present invention when performing certain exercises, or in the event that the user is tall.

The treadmill belt (10) of the preferred embodiment of the present invention is preferably made of a rubber composite material, capable of providing reliable and adequate traction for the user, while remaining flexible enough to traverse the treadmill rollers (30) and friction-reduction rollers (35) easily, without building heat. As shown, there are preferably two treadmill rollers (30), one positioned at the front of the treadmill deck (60) and one positioned at the rear of the treadmill deck (60). The friction-reduction rollers (35) are also preferably equipped with a silicone or rubber composite material to help the friction-reduction rollers (35) to maintain a stable grip with the treadmill belt (10), especially when high braking force is applied. The front and rear treadmill rollers (35) are weighted in order to have a flywheel effect while the belt is in motion.

Figure 4:
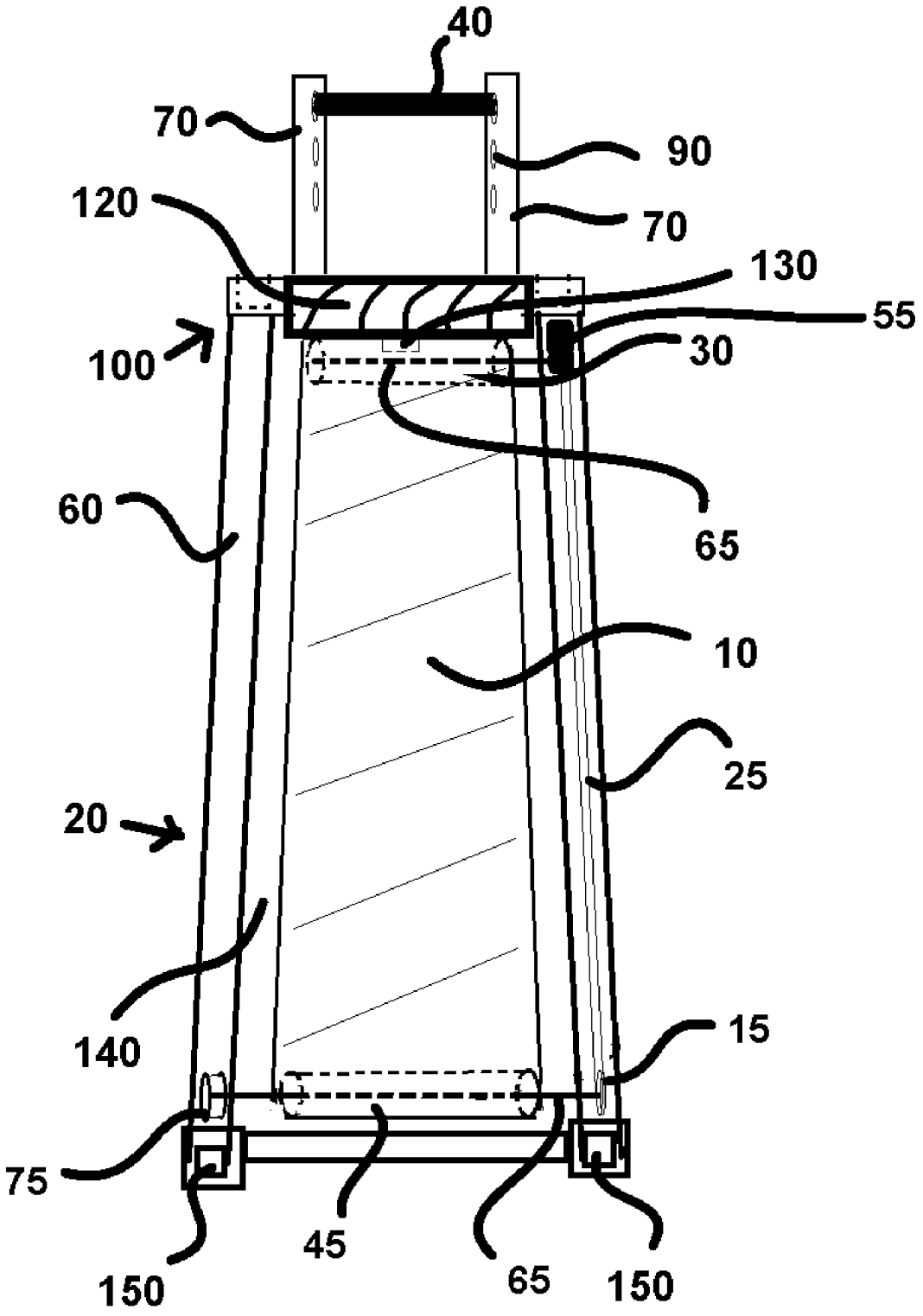
FIG. 4 exhibits a view of the braking system of the present invention as shown from above.

Additionally, the friction-reduction rollers (35) make the treadmill deck (60) stronger and more durable than a traditional treadmill deck, and are more cost effective than other low-friction roller bearing systems, such as slat belt treadmills. The use of spacer plates (95) between each roller can also be used. This reduces the feeling of each individual roller and allows the deck to feel like a continuous surface. Resistance of the treadmill belt (10) may be increased or decreased by adjusting the treadmill rollers (30), applying a brake to the system either by limiting their rotational speed capacity with friction supplied by a variety of weighted wheels, via a resistance band configured to slow the rotation of the treadmill rollers (30), magnetic, or via other conventional means. The brake may be a uni-directional brake, which is configured to only provide resistance when the user is pulling forward, and is configured to allow free movement when the user slides back down the treadmill deck (60) via the treadmill belt (10). This allows the belt to have an oscillating movement. One of such braking system is shown in FIG. 4, which displays a sprocket (15), a chain (25), a gear box (55), at least one axle (65), and a weighted flywheel (75).

It should be understood, particularly, that the present invention can be made with both a bi-directional brake and a uni-directional brake. While the present invention is in the bi-directional brake setting the treadmill belt (10) will have the same amount of resistance moving both forward and backwards. This allows users to be able to perform forward and backwards movement without the need to switch the hand frame from the front of the machine to the back of the machine. A uni-directional brake is configured to only provide resistance when the user is moving forward, and is configured to allow free movement when the user moves backward down the treadmill deck (60) via the treadmill belt (10). This allows the treadmill belt (10) to be able to retract back to its original position. The treadmill belt (10) is able to retract back to the original position of the treadmill belt (10) via gravity and body weight of the user when the front of the present invention is inclined—or via springs, cables, or other similar devices that cause force when the treadmill is not inclined but level. Thus, the present invention allows the user to perform both concentric and eccentric movements.

As such, it should be understood that the preferred embodiment of the present invention allows users to perform both eccentric and concentric muscle contraction. Additionally, an electro-magnetic brake could be employed to control the percentage of weight that is suspended or augmented as the user slides forward and backward during exercise on the treadmill belt (10). There are other means which allow for the treadmill belt to oscillate, such as having mechanical or electrical mechanisms apply force to the belt, or employing rollers or shafts to reverse direction of the treadmill belt (10) However, the uni-directional brake is preferred, as cost of the present invention is better managed. It is envisioned that a bi-directional brake may be employed in lieu of the unidirectional brake in some embodiments of the present invention.

Unlike traditional treadmills or elliptical machines, the exercise sled device of the present invention may be equipped with a padded knee area (120) rather than a simple, commonly plastic mechanical covering to cover the motor. Additionally, the present invention is equipped with an emergency stop mechanism (130), and a treadmill deck frame (140). The treadmill deck frame (140) lines the exterior of the treadmill deck (60), and provides the user a place to stand while not standing on the treadmill belt (10). The padded knee area (120) is preferably disposed at the front end of the treadmill (10), and provides the user with a safe location to rest their knees on for rest if needed. Additionally, the padded knee area (120) is in communication with the emergency stop mechanism (130), which is preferably activated when the padded knee area (120) is in use, or pressure is applied to the knee pad of the padded knee area (120). The padded knee area (120) can also be used by the individual as a seat or pad when performing certain resistance exercises that has the user in a seated or kneeling position.

Some embodiments of the present invention may be equipped with a battery or user-powered on-board computer, configured to measure the distance traversed on the treadmill (10), the elapsed time of the workout, potential calories burned by the user, and other conventional measurements. It should be noted that all embodiments of the present invention are envisioned to be mechanically driven by the user, requiring no AC power for the complete exercise functionality of the present invention to be utilized; however, it is envisioned that electrical components could be used. It is also envisioned that a digital screen or computer could guide users through workout programs, and make all manual adjustments necessary i.e. the adjustments of the hand frame, incline, or resistance. The present invention preferably employs manually applied resistance methods, such as those reinforced by weight, spring tension, friction-based, or other similar methods, to provide a variety of resistance levels to the treadmill belt (10) for the user to employ during a workout.

It should be noted that all embodiments of the present invention are configured to be easily stored, and are configured to occupy minimal space when stored. For example, the at least one vertical post (70) is preferably removable, so as to facilitate folding of the device. Additionally, the hand rail (40) may also be removed, and in some embodiments, the hand rail (40) is configured to fold within the treadmill deck (60).

Additionally, it should be understood that, during use, the present invention is preferably angled so that the incline of the treadmill deck (60) of the present invention causes gravity to provide resistance during the workout. However, the machine may be built at such an angle, or manufactured flat, depending on the intended functionality of the present invention. As such, the present invention preferably does not employ any springs, providing smoother oscillating movement of the body (when configured for oscillation), more control over the resistance of the exercise, and ultimately a more comfortable workout.

Similarly, it should be understood that the treadmill belt (10) can be retracted back to its original position after use. For example, as an individual uses straps via the at least one vertical post (70), to pull themselves forward, the treadmill belt (10) will retract backwards to the original position once the forward motion is stopped. This allows for users to execute eccentric and concentric muscle contractions that traditional exercise sleds are unable to perform. It should be understood that the retraction of the treadmill belt (10) preferably only occurs during a selected setting. Settings of the present invention may be set manually or electronically.

Unless in retraction mode, in the preferred embodiment of the present invention, the treadmill belt (10) is configured to stop movement immediately after the user stops engaging the treadmill belt (10). Most conventional treadmills, with or without a motor, often take several seconds for the belt to come to a complete stop. Having the belt immediately cease movement after it is disengaged or requested is safety feature of the present invention, which helps to prevent injury. The ceasing of the treadmill belt (10) is preferably facilitated by the treadmill rollers and resistance reduction rollers (35), which are preferably weighted.

It should be understood that the resistance reduction rollers (35) currently employed by the present invention are preferably 1.9 inch in diameter, although it is envisioned that 2.5 inch diameter resistance reduction rollers (35) may need to be used for weight capacity purposes. Smaller rollers may reduce the feel of the resistance reduction rollers (35) below the feet of the user. Spacer plates between each roller may be used in order for the user to not feel the rollers underneath them. The size of the font and rear treadmill rollers (30) are larger than the resistance reduction rollers (35) at 4 inches to add more surface area to transfer the braking force from the treadmill roller (30) to the treadmill belt (10).

Additionally, the preferred method of resistance is via a magnetic or direct friction brake, which is preferably housed within the gear box (55). Presently, the present invention is made with a hysteresis magnetic brake (125), which allows for smooth constant resistance across the treadmill belt (10). Magnetic brakes have a very long lifetime. The brake is attached to a shaft or chain (25) that runs to the gear box (55) to increase braking force. The gear box (55) is preferably in communication with the front roller (35). The brake can also be directly connected to the front roller (30), omitting the need for a gearing. Friction braking could be used to reduce the cost of manufacturing the present invention. It should be understood that the brake system of the present invention need not require the gear box (55) to function, as other braking methods may be employed. Additionally, some embodiments of the present invention may not include a braking system, but instead rely on the user to stop manually. During use, it should be understood that the present invention is preferably positioned at an incline or angle to facilitate gravity-based retraction of the belt for each exercise requiring oscillation of the treadmill belt (10).

There are two primary means by which the present invention may be configured to reverse. The first means is by placing a spring carriage, similar to one found in a Pilate's reformer, underneath the treadmill rollers (30) that slides back and forth. The springs of the spring carriage are attached to the rear of the treadmill deck (10) and the spring carriage are attached to a shaft in front of the treadmill, preferably by cables. When the treadmill belt (10) is moved forward, the shaft is rotated, which in turn brings the spring carriage forward elongating the springs. When the treadmill belt (10) stops moving forward, the springs of the spring carriage reverse the direction of the shaft, thereby reversing the treadmill belt (10). This method allows for the retraction of the treadmill belt (10) without the need to incline the treadmill deck (60).

A second method includes the use of a custom shaft coupling. One end of the shaft coupling is attached to the brake, and the other end is attached to the front roller or to a shaft that is connected to the front roller. The end of the coupling that is attached to the front roller or shaft is preferably made with bearings inside. The end that is attached to the brake is preferably fixed, meaning that when the shaft coupling is traveling in one direction, it transfers the braking power to the treadmill belt (10), and when it is traveling the other direction it is spinning freely inside the coupling due to the bearings. With no other mechanical pieces or force, the treadmill belt (10) can retract simply by gravity. To use gravity, the front of the treadmill must be at an incline. The angle of the incline is important, as the greater the incline, the faster the treadmill belt (10) will retract back and vice versa, which form a type of variable resistance for a workout. In such an embodiment, the hand frames are preferably placed both in the front and the rear of the treadmill deck (60). Otherwise, a gear box is required which can be set in forward or reverse.

Additionally, it is envisioned that the functionality of the present invention may be incorporated into conventional or traditional treadmills that employs motors, and not only on manually powered treadmills.

Having illustrated the present invention, it should be understood that various adjustments and versions might be implemented without venturing away from the essence of the present invention, including the use of electronics or a power source. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A stationary sled-style treadmill apparatus comprising:

a treadmill assembly;

a hand bar;

at least one vertical post, said at least one vertical post supporting said hand bar via a hand bar mount;

a treadmill deck;

wherein said treadmill deck has a first end and a second end;

wherein said at least one vertical post is disposed at said first end of said treadmill deck in communication with an extension portion which extends horizontally from, and retracts within said treadmill deck when desired;

a brake system;

wherein said brake system provides variable resistance to said treadmill belt; and wherein said brake system provides consistent resistance across an entirety of said treadmill belt.

2. The apparatus of claim 1, wherein said brake system is magnetic.

3. The apparatus of claim 1, wherein said hand bar is adjustable within a range extending from a first position proximal to said treadmill deck, and a second position extended away from said treadmill deck.

4. The apparatus of claim 1, wherein said brake system includes an eddy current brake.

5. A stationary sled-style treadmill apparatus comprising:

a treadmill assembly;

a front treadmill roller;

a rear treadmill roller;

friction-reduction rollers;

a treadmill belt, said treadmill belt configured to securely wrap around said front treadmill roller, said rear treadmill roller, and said friction-reduction rollers to form a treadmill deck;

wherein said treadmill belt, said front treadmill roller, said rear treadmill roller, and said friction-reduction rollers are housed within said treadmill assembly;

a hand bar, said hand bar in communication with said treadmill assembly;

at least one vertical post, said at least one vertical post supporting said hand bar via a hand bar mount;

wherein said treadmill deck has a first end and a second end;

wherein said at least one vertical post is disposed at said first end of said treadmill deck;

an extension portion, said extension portion disposed on said first end;

wherein said extension portion extends horizontally from, and retracts within said treadmill deck when desired;

a brake system; wherein said brake system provides variable resistance to said treadmill belt;

and wherein said brake system provides consistent resistance across an entirety of said treadmill belt.

6. The apparatus of claim 5, wherein said brake system employs a uni-directional brake.

7. The apparatus of claim 5, wherein said brake system employs at least one magnetic brake.

8. The apparatus of claim 5, wherein said brake system is an electromagnetic brake.

9. The apparatus of claim 5, wherein said brake system is an eddy current brake.

10. The apparatus of claim 5, wherein said brake system includes a bi-directional brake which is a magnetic brake.

11. The apparatus of claim 5, wherein said extension portion is disposed at said first end of said treadmill deck, below said at least one vertical post; and wherein said extension portion slides out and away beyond the treadmill deck when desired, extending the effective length of said treadmill assembly.

12. A stationary sled-style treadmill apparatus comprising:

a treadmill assembly;

a front treadmill roller, said front treadmill roller disposed at a front of said treadmill assembly;

a rear treadmill roller, said rear treadmill roller disposed at a rear of said treadmill assembly;

friction-reduction rollers, said friction-reduction rollers disposed between said front treadmill roller and said rear treadmill roller;

a treadmill belt, said treadmill belt configured to securely wrap around said front treadmill roller, said rear treadmill roller, and said friction-reduction rollers to form a treadmill deck housed within a treadmill deck frame;

wherein said treadmill belt, said treadmill deck, said front treadmill roller, said rear treadmill roller, and said friction-reduction rollers are housed within said treadmill assembly;

a hand bar;

an extension portion, said extension portion configured to slide horizontally into and out of said treadmill deck frame;

at least one vertical post, said at least one vertical post supporting said hand bar via a hand bar mount;

wherein said at least one vertical post is in communication with said extension portion;

wherein said treadmill deck has a first end and a second end; and wherein said at least one vertical post is disposed at said first end of said treadmill deck.

13. The apparatus of claim 12, wherein said extension portion increases the distance between said hand bar and said treadmill deck when said extension portion is extended.

14. The apparatus of claim 12, wherein said extension portion decreases the distance between said hand bar and said treadmill deck when said extension portion is retracted.

15. The apparatus of claim 12, wherein said hand bar extends in a plane that is perpendicular to a primary plane of said treadmill deck.

16. The apparatus of claim 12, wherein said hand bar mount is disposed in communication with said hand bar and said at least one vertical post.

17. The apparatus of claim 12, wherein the at least one vertical post is configured to be adjusted horizontally such that the distance between iterations of said at least one vertical post is configured to be adjusted.

* * * * *